US005901590A

United States Patent [19]

Lai

[11] Patent Number: 5,901,590

[45] Date of Patent: May 11, 1999

[54] INTERIOR DOOR LOCK ASSEMBLY WITH A SAFETY DEVICE

[76] Inventor: Chin-I Lai, Tainan, Taiwan

[21] Appl. No.: 08/976,612

[22] Filed: Nov. 24, 1997

[51] Int. Cl.[6] ..... E05B 13/00

[52] U.S. Cl. ..... 70/416; 70/210; 292/DIG. 4; 292/DIG. 37

[58] Field of Search ..... 292/177, 179, 292/180, 181, 182, DIG. 4, DIG. 26, DIG. 37; 70/416, 210, 215, 467, 468, 471

[56] References Cited

U.S. PATENT DOCUMENTS

| | | | |
|---|---|---|---|
| 1,379,048 | 5/1921 | Scholl | 70/416 |
| 1,956,388 | 4/1934 | Kalina | 70/416 |
| 2,210,080 | 8/1940 | Hover et al. | 292/DIG. 37 |
| 3,156,493 | 11/1964 | Griffiths | 292/DIG. 4 |
| 3,895,505 | 7/1975 | WasserFaller | 292/150 |
| 4,538,844 | 9/1985 | Watanabe | 292/DIG. 37 |
| 4,702,506 | 10/1987 | Iimura | 292/DIG. 4 |
| 5,327,632 | 7/1994 | Moore | 70/416 |
| 5,421,074 | 6/1995 | Moore | 70/416 |
| 5,562,317 | 10/1996 | Kuo et al. | 292/DIG. 26 |
| 5,671,957 | 9/1997 | Raffini | 292/DIG. 37 |

FOREIGN PATENT DOCUMENTS

| | | | |
|---|---|---|---|
| 689828 | 6/1964 | Canada | 292/DIG. 4 |
| 329622 | 4/1912 | France | 292/150 |
| 185383 | 10/1936 | Switzerland | 292/150 |

*Primary Examiner*—Damell M. Boucher
*Attorney, Agent, or Firm*—Rosenberg, Klein & Bilker

[57] ABSTRACT

An interior door lock assembly includes a casing secured to an inner side of a door plate and including a central hole and two diametrically disposed holes. A switch button has a stub extended through the central hole to engage with a tail piece of a lock core to rotate therewith. A press button assembly is mounted to the switch button and includes a seat securely mounted in a compartment defined in the switch button. A spring-biased press button is partially, slidably mounted in the seat. When the switch button is in a latched position, the press button is pressable to engage with one of the holes of the casing to prevent from unlatching of the interior door lock assembly from outside of the door plate.

1 Claim, 4 Drawing Sheets

INTERIOR DOOR LOCK ASSEMBLY WITH A SAFETY DEVICE

BACKGROUND OF THE INVENTION

1. Field of the Invention

The present invention relates to an interior door lock assembly with a safety device to improve security.

2. Description of the Related Art

FIG. 5 of the drawings illustrates a typical door lock assembly which includes an exterior lock assembly 41 mounted to an outer side of a door plate (not labeled), an interior lock assembly, and a latch bolt assembly 43. The exterior lock assembly 41 includes a lock core (not labeled) with a tail piece 411, and a casing 42 is mounted around the exterior lock assembly 41 and constitutes a part thereof. The latch bolt assembly 43 includes a linking plate 431 having a rotating wheel 432 mounted therein through which the tail piece 411 is extended to rotate therewith for moving a latch bolt 433 upon rotation of the tail piece 411. The interior lock assembly includes a casing 44 secured to an inner side of the door plate by means of extending screws 443 through holes 441 defined in the casing 44. A switch button 45 includes a stub 451 formed on a side thereof and extended through a central hole 442 defined in the casing 44. The stud 451 includes a groove 452 defined therein for engaging with the tail piece 411 (a C-clip 453 is used to retain the tail piece 411 in position) to rotate therewith. In use, when a proper key is inserted into a keyway of the lock core from outside, the door lock can be unlatched under rotation of the key. The door lock assembly can also be unlatched from inside under rotation of the switch button 45. In some cases a chain lock 5 is provided to prevent the door from being opened from outside. Installation and use of the chain lock 5 is inconvenient. The present invention is intended to provide an improved interior door lock assembly to achieve the purpose of preventing the door from being opened from outside without the use of the chain lock.

SUMMARY OF THE INVENTION

An interior door lock assembly in accordance with the present invention comprises a casing secured to an inner side of a door plate and including a central hole and two diametrically disposed holes. A switch button has a stub extended through the central hole to engage with a tail piece of a lock core to rotate therewith. The switch button further includes a compartment defined therein. A press button assembly is mounted to the switch button and Includes a seat securely mounted in the compartment and a spring-biased cress button partially, slidably mounted in the seat.

When the switch button is in a latched position, the press button is pressable to engage with one of the holes or the casing to prevent from unlatching of the interior door lock assembly from outside of the door plate.

In an embodiment of the invention, the seat includes an end opening through which the press button slidably extends. The seat further includes a lateral side having a side opening and a second hole defined therein. The press button includes a press end and a shank having a slot and a positioning hole defined in a side thereof. A positioning rod includes a first end extended through the side opening of the seat and thus positioned in the positioning hole of the press button and a second end extended into the second hole of the seat and slidable along the slot of the press button. The positioning hole includes a first end and a second end, and a spring includes a first end attached to the positioning rod and a second end attached to the press end of the press button. A first press of the press button causes the first end of the positioning rod to be secured by the first end of the positioning hole while the spring is compressed and the shank of the press button is extended into one of the first-mentioned holes of the casing to thereby prevent from rotational movement of the switch button. A further press of the press button causes the first end of the positioning rod to be secured by the second end of the positioning hole while the spring is released to return the press button to thereby disengage the shank from the casing.

Preferably, a plastic housing is provided for enclosing a part of the press button which extends beyond the seat.

Other objects, advantages, and novel features of the invention will become more apparent from the following detailed description when taken in conjunction with the accompanying drawings.

DESCRIPTION OF THE PREFERRED EMBODIMENT

Figure 1:
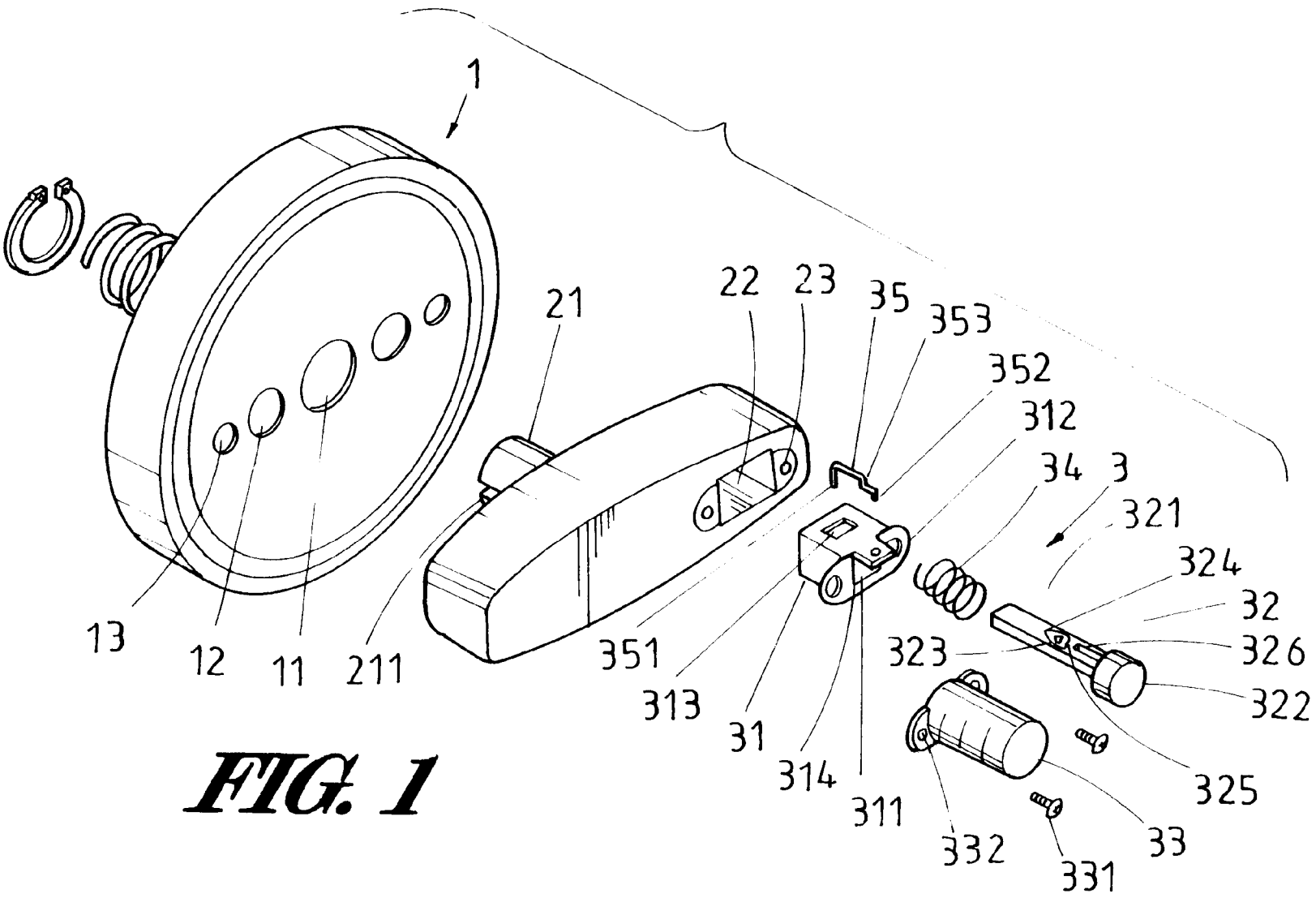
FIG. 1 is an exploded perspective view of an interior door lock assembly in accordance with the present invention.
Figure 4:
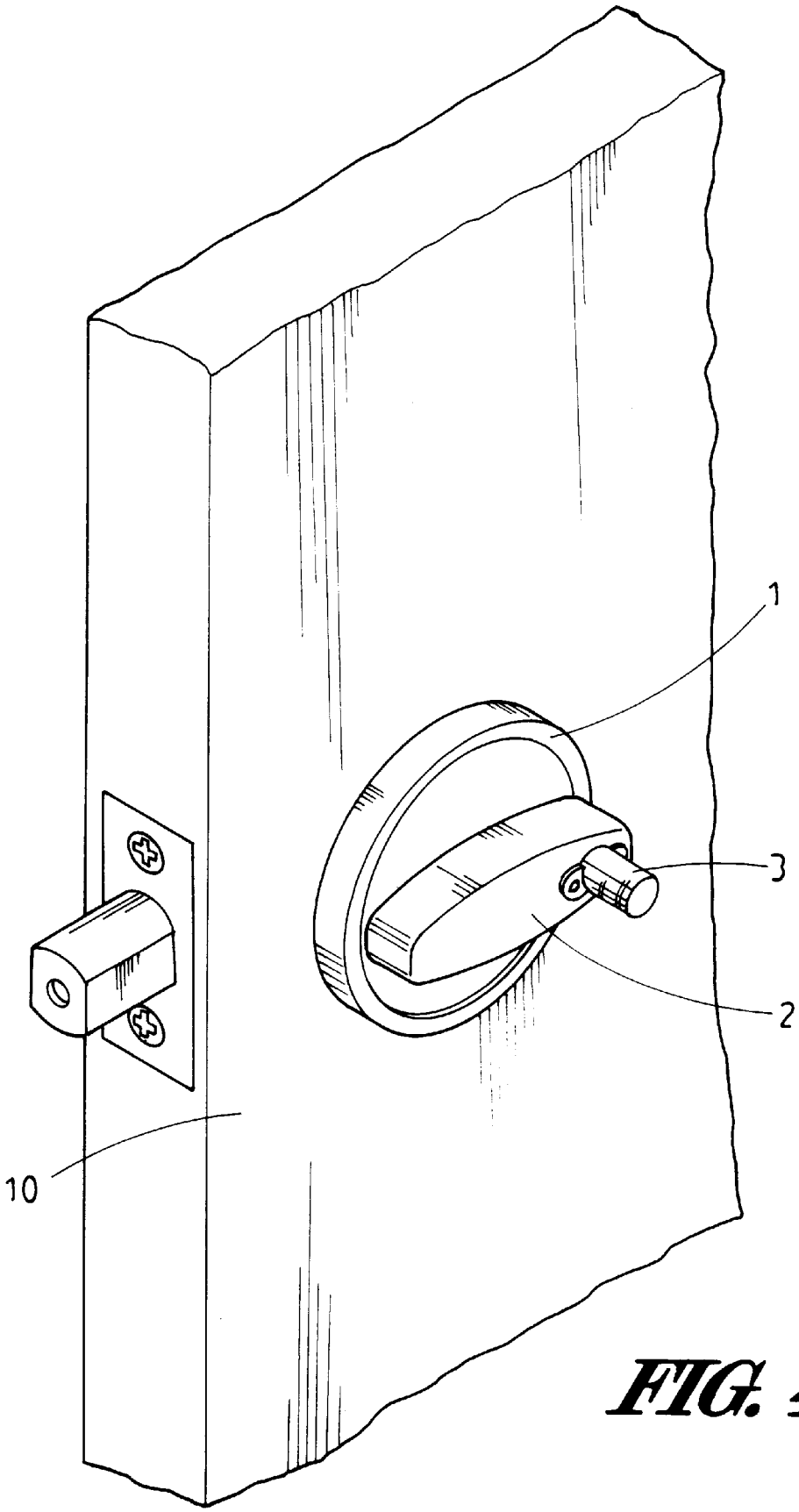
FIG. 4 is a perspective view illustrating a door plate having the interior door lock assembly of the present invention mounted thereon.
Figure 5:
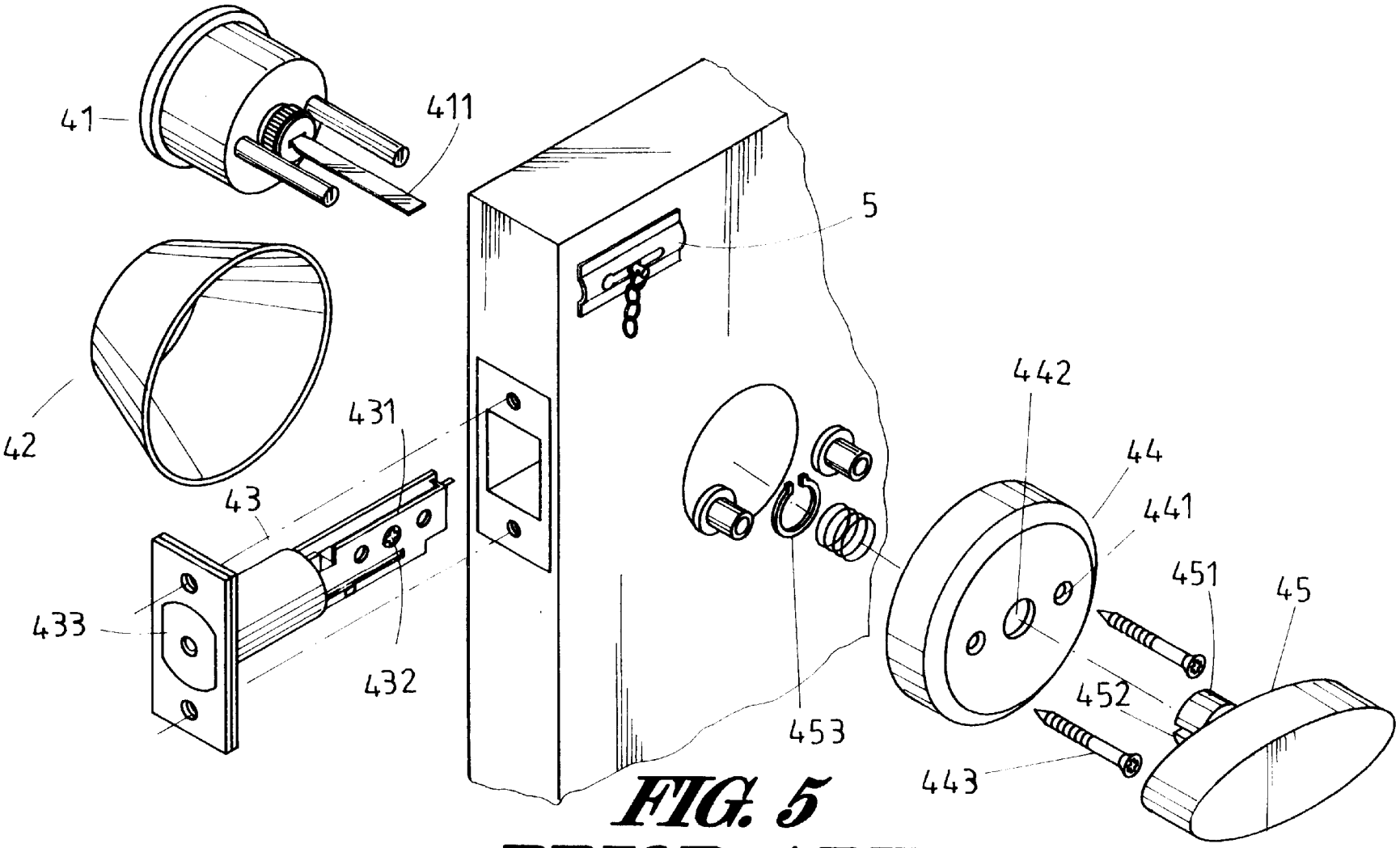
FIG. 5 PRIOR ART
FIG. 5 is an exploded perspective view illustrating a prior art door lock assembly.

Referring to FIGS. 1 to 4 and initially to FIGS. 1 and 4, an interior door lock assembly in accordance with the present invention comprises a casing 1 secured to an inner side of a door plate 10 by means of extending screws (not shown) through holes 12 defined in the casing 1. The casing 1 further comprises a central hole 11 and two diametrically disposed holes 13 which will be described later. A switch button 2 has a stub 21 with a groove 211 rotatably extended through the central hole 11 to engage with a tail piece (not shown) of a lock core (not shown) to rotate therewith. The switch button 2 further includes a compartment 22 defined therein, and a press button assembly 3 is mounted to the switch button 2 which will be described in detail hereinafter.

The press button assembly 3 includes a seat 31 securely mounted in the compartment 22, a press button 32 partially, slidably mounted in the seat 31, and a plastic housing 33 for enclosing a part of the press button 32 which extends beyond the seat 31. The seat 31 includes an end opening 311 through which the press button 32 slidably extends. The seat 31 further includes a lateral side having a side opening 313 and a hole 314 defined therein. The press button 32 includes a press end 322 and a shank 321 having a slot 326 and a positioning hole 323 defined in a side thereof. A positioning rod 35 includes a first end 351 extended through the side opening 313 of the seat 31 and thus positioned in the positioning hole 323 of the press button 32 and a second end 352 extended into the hole 314 of the seat 31 and slidable along the slot 326 of the press button 32. In this embodiment, the first end 351 of the positioning rod 35 is secured by either one of two ends 324 and 325 of the positioning hole 323. The positioning rod 35 further includes a section 353 to which a first end of a spring 34 is attached, and a second end of the spring 34 is attached to the press end 322 of the press button 32. Screws 331 are extended through holes 332 defined in the plastic housing 33, holes 312 defined in the seat 31, and holes 23 defined in the switch button 2 to complete the assembly.

Figure 2:
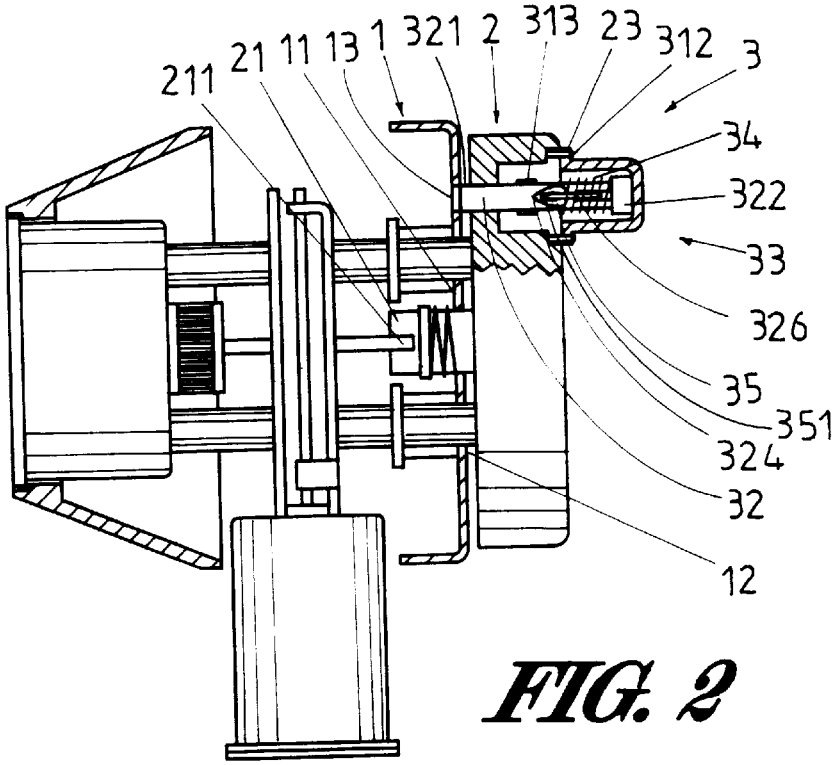
FIG. 2 is a cross sectional view of a door lock assembly incorporating the interior door lock assembly in accordance with the present invention, wherein a press button of the interior door lock assembly is in an extended position.
Figure 3:
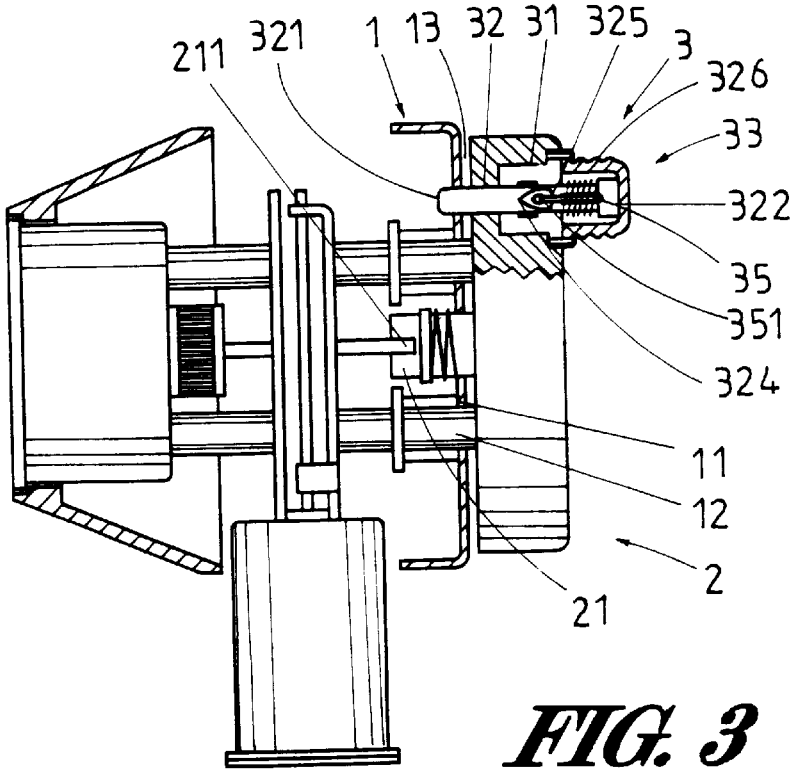
FIG. 3 is a view similar to FIG. 2, wherein the press button of the interior door lock assembly is pressed.

In use, referring to FIG. 2, in which the press button 32 is in an extended position. When the press button 32 is pressed once to a position shown in FIG. 3, the first end 351 of the positioning rod 35 is secured by the end 324 of the positioning hole 32, while the spring 34 is compressed and the shank 321 of the press button 32 is extended into one of the holes 13 defined in the casing 1 to thereby prevent from rotational movement of the switch button 2, i.e., the door lock cannot be unlatched under this status. When the press button 2 is pressed again, the first end 351 of the positioning rod 35 is secured by the other end 325 of the positioning hole 32, while the spring 34 is released to return the press button 32 to thereby disengage the shank 321 from the casing 1. Accordingly, the door lock can be unlatched from either inside or outside.

According to the above description, it is appreciated that the door lock cannot be unlatched from outside when the press button 32 is pressed to thereby prevent from access by unauthorized person without the use of the chain lock.

Although the invention has been explained in relation to its preferred embodiment, it is to be understood that many other possible modifications and variations can be made without departing from the spirit and scope of the invention as hereinafter claimed.

What is claimed is:

1. An interior door lock assembly, comprising:

a casing secured to a door plate, said casing including a central hole and two apertures spaced radially from said central hole and at opposite sides thereof;

a switch button mounted to said casing, said switch button including a compartment defined therewithin and a stub extending through said central hole of said casing and engaging a tail piece of a lock core, said switch button having latched and unlatched positions thereof; and a press button assembly mounted to said switch button, said press button assembly comprising:

(a) a press button having a press end and an elongated shank extending from said press end, a positioning hole disposed at said shank and having first and second ends thereof, and a slot extending along said shank between said press end of said press button and said second end of said positioning hole;

(b) a seat installed within said compartment defined within said switch button, said seat including a walled body having an end opening extending along said walled body and slidingly receiving said shank of said press button, and first and second side openings spacedly disposed in one of walls of said walled body of said seat;

(c) a positioning rod extending outside of said walled body of said seat, said positioning rod having:

a first end protruding through said first side opening in said seat and engaging either one of said first and second ends of said positioning hole disposed on said press button, a second end protruding through said second side opening in said seat and slidably engaging said slot in said press button, and an intermediate section; and (d) a spring member having first and second ends thereof, said first end of said spring member being coupled to said intermediate section of said positioning rod, and said second end of said spring member being coupled to said press end of said press button;

in said latched position of said switch button, when said press end of said press button has been pressed once, said first end of said positioning rod engaging said first end of said positioning hole on said press button, said spring member being compressed, and said shank of said press button extending into one of said two apertures on said casing, thereby preventing unwanted unlatching of said door lock assembly, and in said unlatched position of said switch button, when said press end of said press button has been pressed again, said first end of said positioning rod engaging said second end of said positioning hole on said press button, said spring member being released, and said shank of said press button being retracted from said one of said two apertures on said casing, thereby unlatching said door lock assembly.

* * * * *